US006374743B1

(12) United States Patent
Hug et al.

(10) Patent No.: US 6,374,743 B1
(45) Date of Patent: Apr. 23, 2002

(54) JACKETED PROJECTILE WITH A HARD CORE

(75) Inventors: Carl Hug, Oberdiesbach; Beat Messerli, Uetendorf, both of (CH)

(73) Assignee: SM Schweizerische Munition Sunternehmung AG, Thun (CH)

( * ) Notice: Subject to any disclaimer, the term of this patent is extended or adjusted under 35 U.S.C. 154(b) by 0 days.

(21) Appl. No.: 09/486,216

(22) PCT Filed: Aug. 24, 1998

(86) PCT No.: PCT/IB98/01314

§ 371 Date: Feb. 18, 2000

§ 102(e) Date: Feb. 18, 2000

(87) PCT Pub. No.: WO99/10703

PCT Pub. Date: Mar. 4, 1999

Related U.S. Application Data

(60) Provisional application No. 60/057,566, filed on Aug. 26, 1997.

(51) Int. Cl.[7] ..... F42B 12/78; F42B 30/02

(52) U.S. Cl. ..... 102/518; 102/518; 102/516; 102/517; 102/514; 102/519

(58) Field of Search ..... 102/516, 517, 102/518, 519, 514

(56) References Cited

U.S. PATENT DOCUMENTS 3,782,287 A * 1/1974 Sie ..... 102/518
3,999,486 A * 12/1976 Bower ..... 102/516
5,009,166 A * 4/1991 Bilsbury et al. ..... 102/516
5,394,597 A * 3/1995 White ..... 102/516

FOREIGN PATENT DOCUMENTS

| | | | | |
|---|---|---|---|---|
| DE | 0550418 | * | 1/1943 | 102/518 |
| FR | 0812377 | * | 5/1937 | 102/518 |
| SE | 592538 | * | 12/1941 | 102/517 |
| SE | 0166228 | * | 2/1959 | 102/518 |

OTHER PUBLICATIONS

"The Online Materials Information Resource", http://www-.matweb.com.*

* cited by examiner

*Primary Examiner*—Peter M. Poon
*Assistant Examiner*—Lulit Semunegus
(74) *Attorney, Agent, or Firm*—Schweitzer Cornman Gross & Bondell LLP

(57) ABSTRACT

The invention relates to a jacketed projectile (100), comprising a tungsten carbide hard core (5) on the front side and an centered, interlocking soft core (8) placed on the hard core (5). A closed air space (6) is located between the front area (5*a*) of the hard core (5) and the tip of the projectile (4). This projectile configuration provides a very high penetration potential and good dynamic and ballistic properties, enabling the inventive projectiles to be used as munition for police snipers, especially to hit targets located behind a glass.

10 Claims, 9 Drawing Sheets

JACKETED PROJECTILE WITH A HARD CORE

Figure 1:
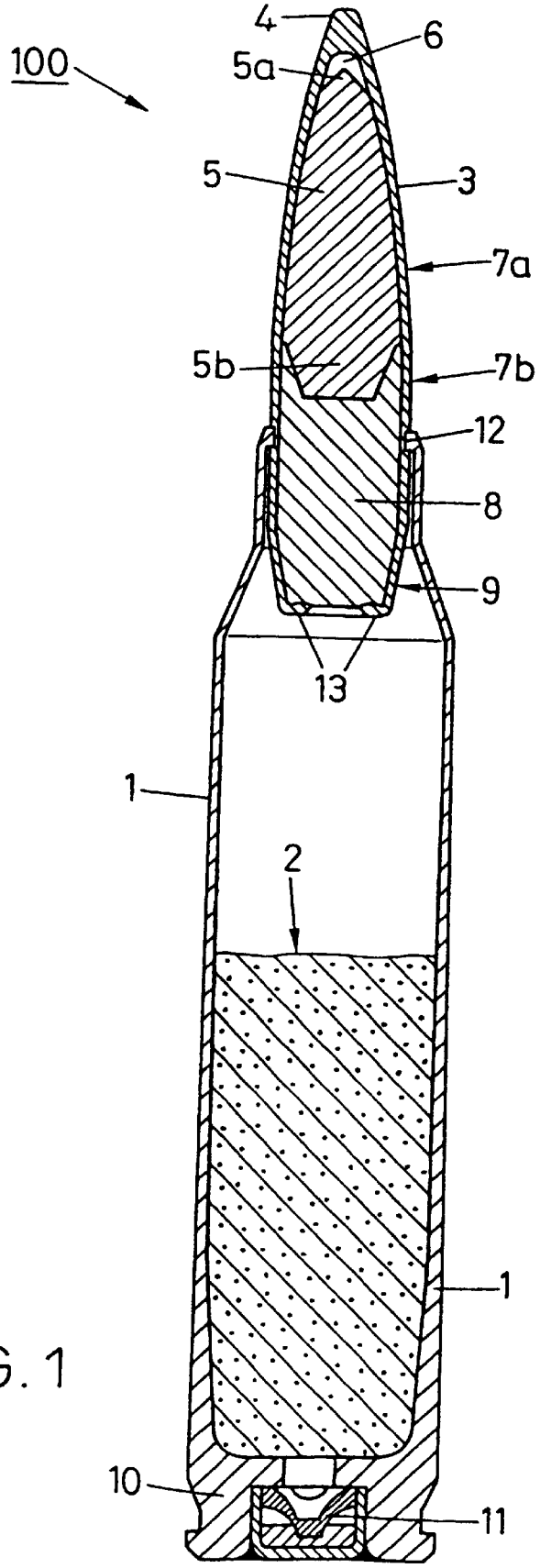

This application is a 371 of PCT/IB98/01314 filed Aug. 24, 1998 which claims benefit of Prov. No. 60/057,566 filed Aug. 26, 1997.

The present invention relates to a jacketed projectile having both hard and soft core portions.

The present invention relates to a projectile according to the precharacterizing clause of claim 1.

Hard-core small-calibre ammunition is used in particular by marksmen and is intended for the precise penetration of armoured targets. Armoured targets within the meaning of the subject matter of the invention are protective vests (for people), armoured glass, steel plates and light-metal armouring.

A wide variety of such ammunition is known. It can be divided up into ammunition with steel cores, ammunition with hard cores made of dense sintered material and ammunition with a medium added to the hard core such as lead, aluminium and/or air. A common feature of this ammunition is a steel jacket, generally designed as a full jacket, a plated steel jacket or tombac jacket, which receives the cores and media and encloses them at least in a fluid-tight manner.

A jacketed, projectile with a lead core in the shape of a truncated cone at the tail and with a jacket encompassing the lead core and made of steel or a tombac alloy is presented in EP-A1-0 499 832. To reduce deposits in the barrel of portable firearms, the jacket is additionally plated with a thin layer of tin.

GB-A-592 538 discloses a small-calibre projectile in which the hard core is mounted unsupported in the projectile jacket between the front region of the latter and a body made of light metal, at the tail. As a result, the desired weight distribution is obtained, manufacturing tolerances compensated for, and in addition the friction in the gun barrel reduced.

A further jacketed projectile is disclosed by GB-A-601 686 which has a special design of a hard and soft core favourable in terms of fabrication. The hard core at the front has, for this purpose, in part, smaller diameters than the interior of the jacketed projectile; the hard core is likewise supported by a soft body made of light metal, with an axial overlength, which body has, at the front, a recess which serves for centring the hard core and merges into a further, spherical-cap-shaped hollow space. This gives rise to gaps and recesses between the cores and the jacket, which allows material displacements and results in compressibility when the projectile is being pressed and closed, thereby allowing compensation for fabrication tolerances.

Owing to their geometry and internal and external ballistics, the known projectiles have inadequate first-hit probability and, with armoured targets, show inadequate penetration capability.

WO 89/03015 describes a projectile for a large-calibre firearm, in particular for a cannon, the projectile having a form-fitting connection between the projectile jacket and its core in order to increase the penetration capacity and prevent stripping of the projectile jacket. In addition, special core shapes and configurations of the tail, as well as constrictions in the middle part and tail part of the projectile, are shown. A hollow space, provided in a variant, between an acute-angled front region of the core and the interior of the jacket is filled with lubricating grease, plastic or powder to retain the shape of the head in the target; this additionally reduces the resulting friction during assembly.

The proposed measures and means are applicable only in a very limited manner to small-calibre ammunition and increase the cost of this considerably EP-A2-0 106 411 discloses small-calibre ammunition and manufacturing processes therefor. The appropriately optimized and manufactured projectiles serve mainly as infantry combat ammunition and already have good aerodynamic properties. However, this ammunition does not possess the high terminal ballistic energy which is required by marksmen and is necessary for the penetration of armouring.

It is therefore the object of the invention to provide small-calibre ammunition which does not have the disadvantages of the prior art and in particular possesses a high penetration capacity with armoured targets, low crosswind sensitivity and also increased precision.

The ammunition to be provided is intended to enable the marksmen precisely to combat targets located behind glass during a police operation.

This object is achieved by providing a jacket having ogive, cylindrical, and conical portions into which is form-fitted a forward hard core and a rearward soft core. The hard core is fitted to the ogive portion of the jacket and has a truncated-cone tail region. The soft core is form-fitted against the tail region and fills the entire cylindrical and conical tail regions of the jacket.

It has been found that the form-fitting contact of the hard core against the likewise ogive-shaped internal shape of the jacket results in an extremely compact, rotationally symmetrical and dimensionally accurate body with very good aerodynamic, ballistic and penetration properties.

The front region, which is smaller by comparison with the internal shape, of the hard core ensures the close fitting of the latter against the external shape and encloses therewith an air space which promotes the easy stripping of the jacket from the hard core upon entry of the projectile into armouring, so that the hard core penetrates the armouring in the manner of dart ammunition. In addition, this air space helps to compensate for manufacturing tolerances between the jacket and the hard core.

The middle part, which is filled with a relatively soft material, prevents inadmissible friction and thus additional energy losses in the gun barrel, by virtue of its albeit low deformability. Furthermore, this also results in lower barrel erosion, which increases the service life of the weapon employed. The soft core is centered flange-like on the truncated-cone-shaped hard core, so that no unbalance results upon the rotation of the projectile produced by the rifling of the barrel groove.

The end of the soft core is likewise configured in the shape of a truncated cone; the jacket encompasses the soft core in a form-fitting manner as well, and this in turn results in a high dimensional accuracy and prevents swirling in the tail region of the projectile, and among other things produces the low deceleration on the trajectory which is observed.

In terms of manufacture, there are no special requirements to be met with this type of ammunition, apart from that of low roughness of the hard-core surface in order to obtain the desired form fit with the jacket.

According to the process, the prefabricated hard core is tumbled in a water-filled drum for several hours until the surface of the hard core is smooth and is visibly fine owing to a dull gloss.

Plating by means of a copper/zinc alloy, known per se, reduces the friction in the barrel and, in conjunction with the core located in the cylindrical part of the jacket, results in the surprisingly high initial velocities $V_0$ this with conventional propelling charges as well.

In respect of the penetration capacity, hardness and absolutely essential high density, a ceramic hard core made of cobalt-alloyed tungsten carbide (WC/Co 88/12) with a density of 14.3 g/cm$^3$ has proved outstandingly suitable.

A soft core made of a lead/tin alloy (Pb/Sn 60/40) with a density of 9.2 g/cm$^3$ meets all the requirements in respect of compliance (low hardness) and the necessary mass for achieving the terminal-ballistic power.

The weight ratios for a total projectile mass of 100% are 42% to 50%, preferably 44% of hard-core mass, 28% to 34%, preferably 31% of soft-core mass and preferably 25% of the total mass for the jacket. For small-calibre ammunition, this results in an ideal weight distribution in the projectile, i.e. the centre of mass is optimal for a ballistic trajectory.

By inserting a thin brass disc, prior to the flanging of the jacket, in the tail of the projectile, the cores are enclosed in a gastight manner, thus eliminating the emission of heavy metals upon firing.

An optimal rotationally symmetrical centering of the soft core on the hard core is obtained by cone angles between 14° to 18°, preferably 16.5°.

Smaller cone angles, below 14°, also result in usable centering.

An economically optimal surface treatment of the hard core is that by means of tumbling for several hours, i.e. in practice up to twelve hours, in a water bath at room temperature, during which the cores abrade one another until they are smooth and glossy. Of course, other processes which produce the desired surface fineness and thus form fit in the jacket are also possible.

By manually pushing the cores into the jacket, the expedient manufacturing tolerances can be checked and set, so that no material stresses and/or deformations arise which adversely affect the rotational symmetry of the projectile.

The subject matter of the invention is described in more detail below with the aid of two practical exemplary embodiments.

Figure 1A:
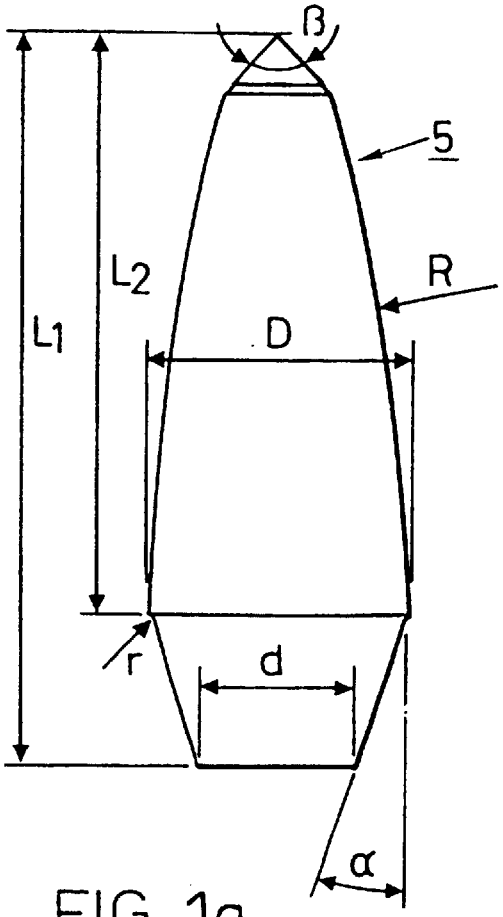
Figure 2:
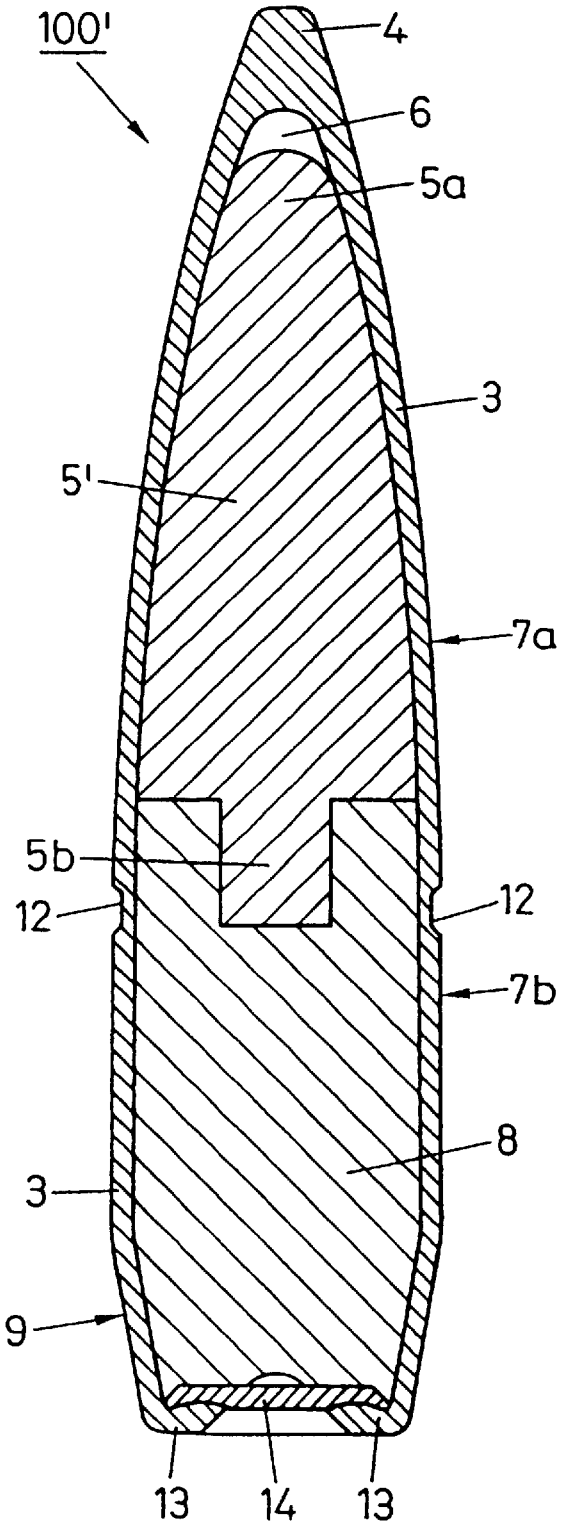
Figure 3A:
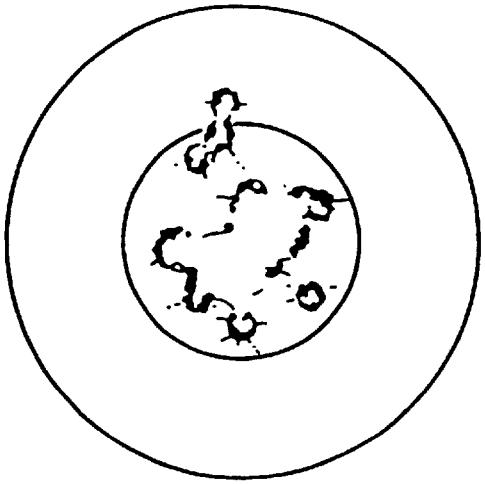
Figure 3B:
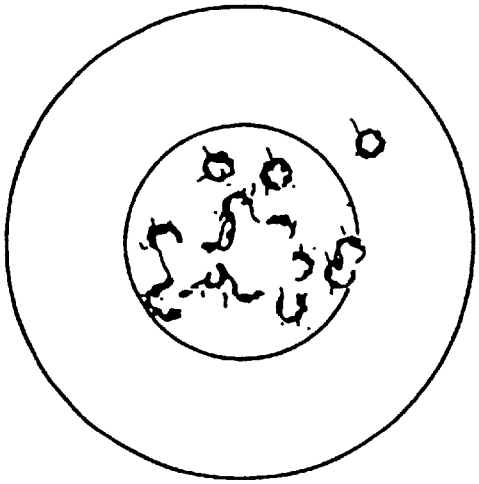
Figure 3C:
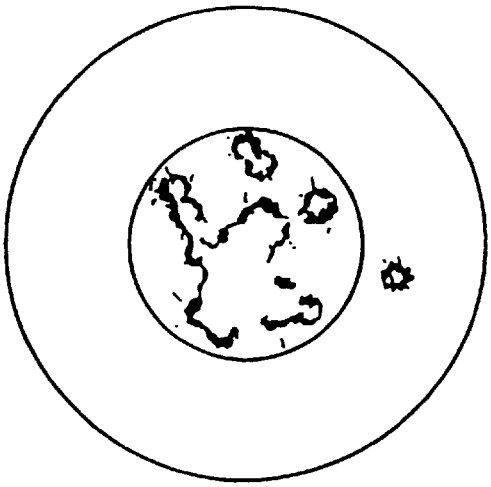
Figure 4:
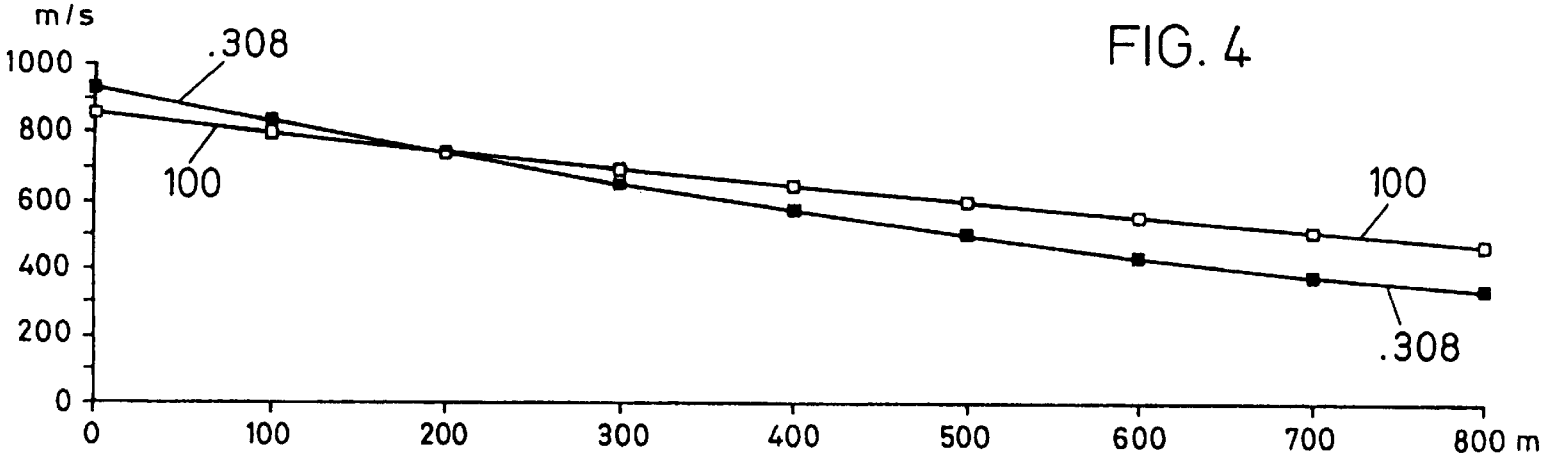
Figure 5:
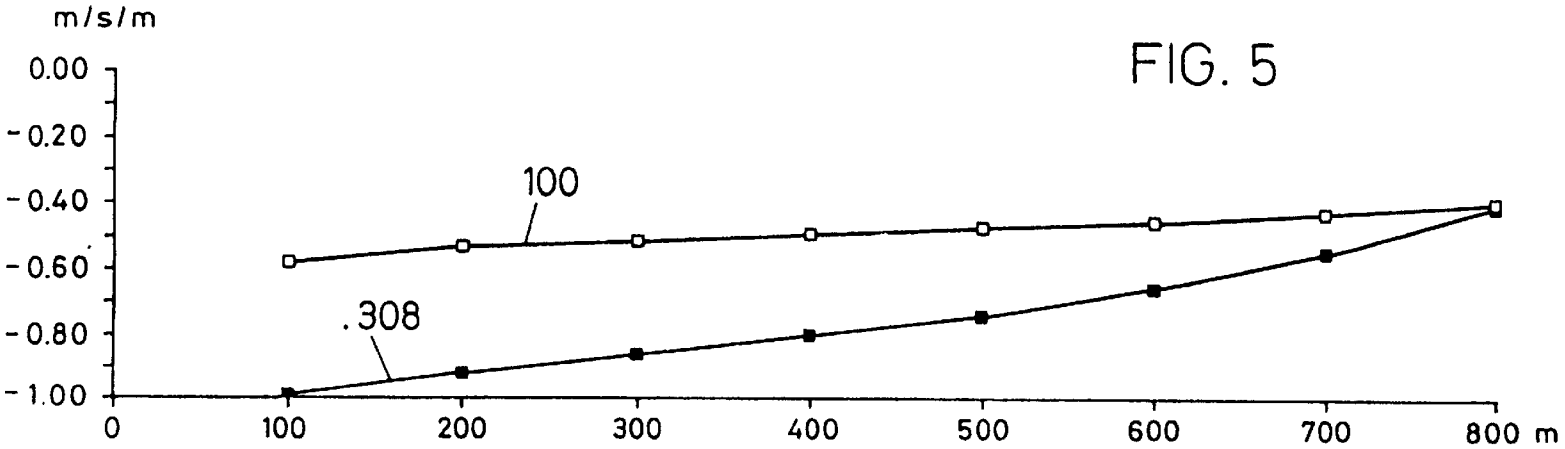
Figure 6:
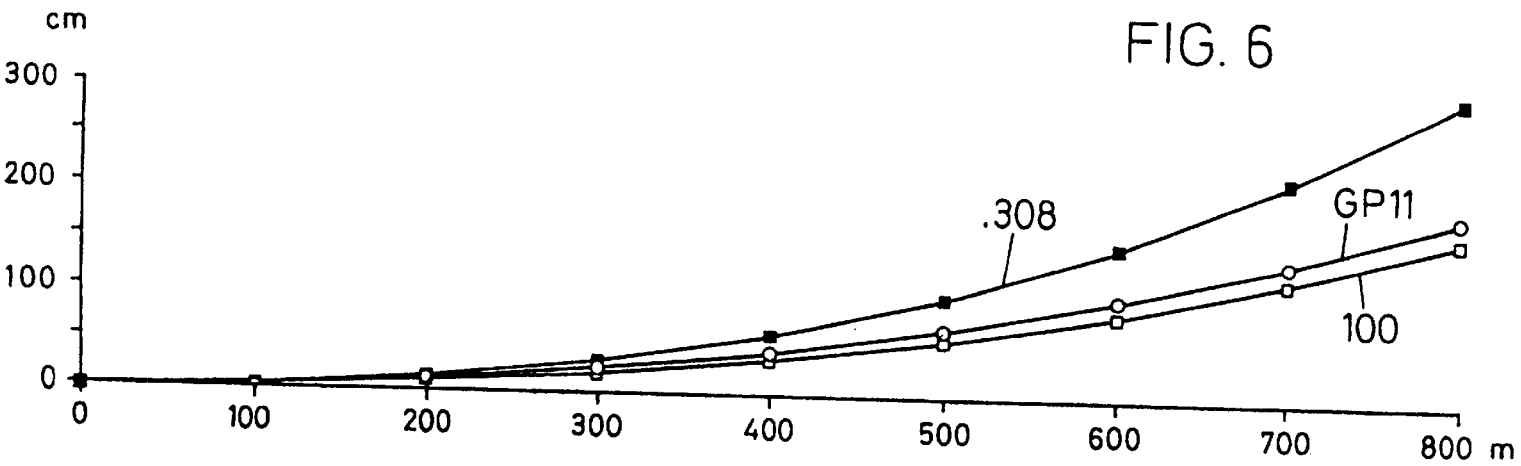
Figure 7:
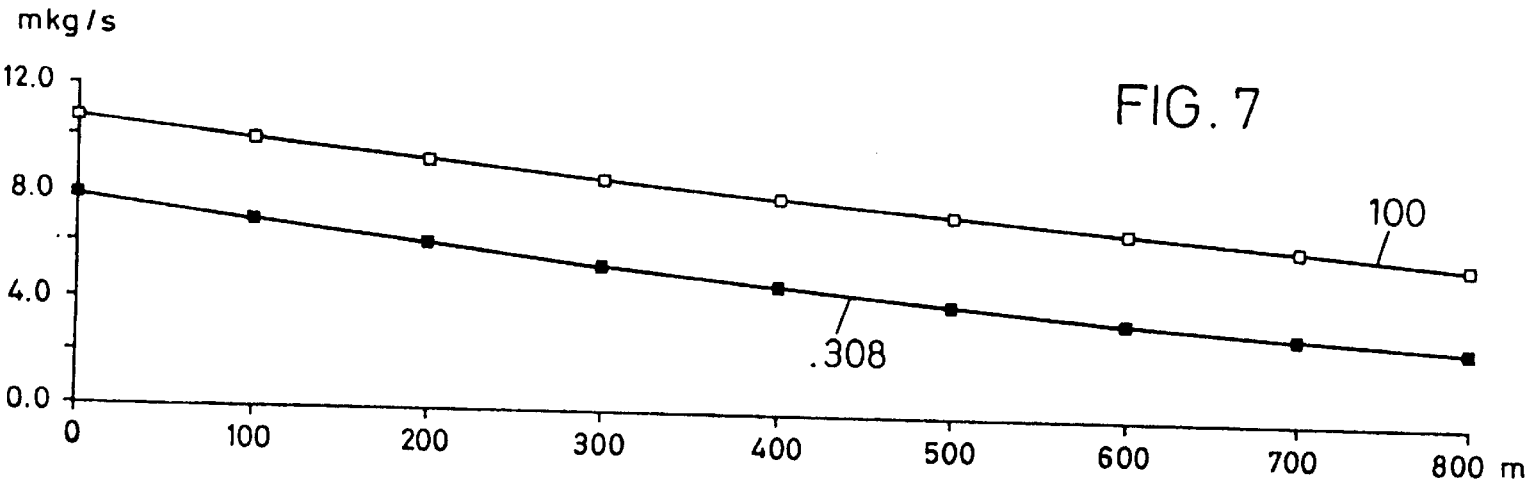
Figure 8:
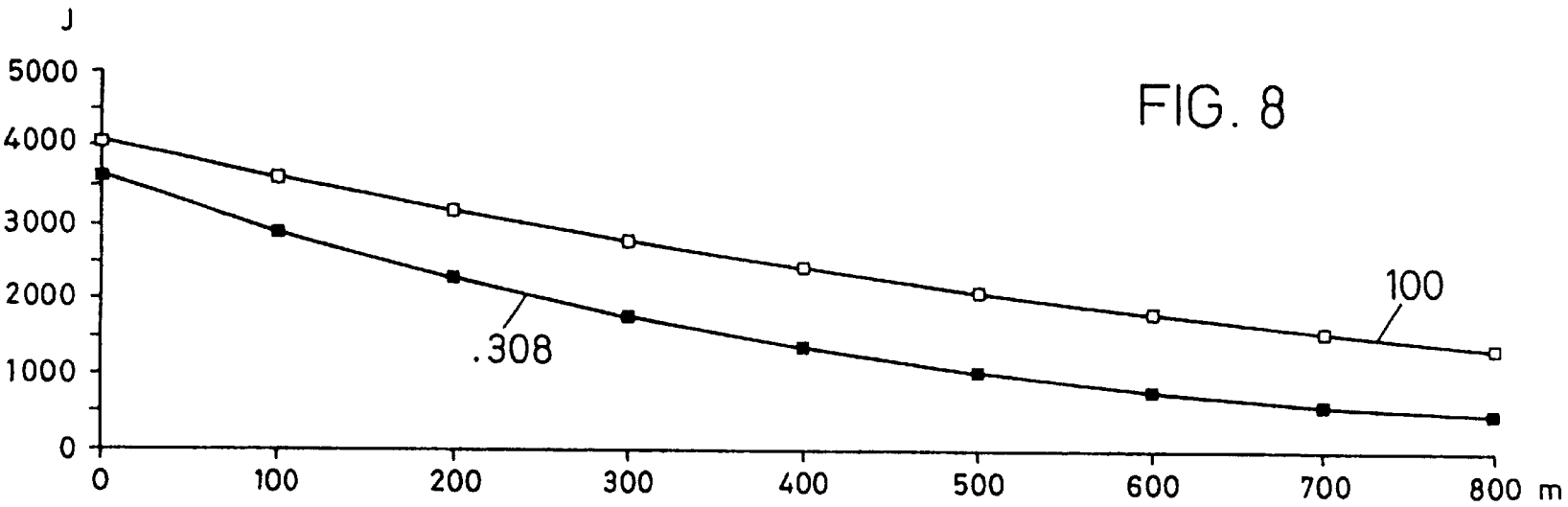
Figure 9:
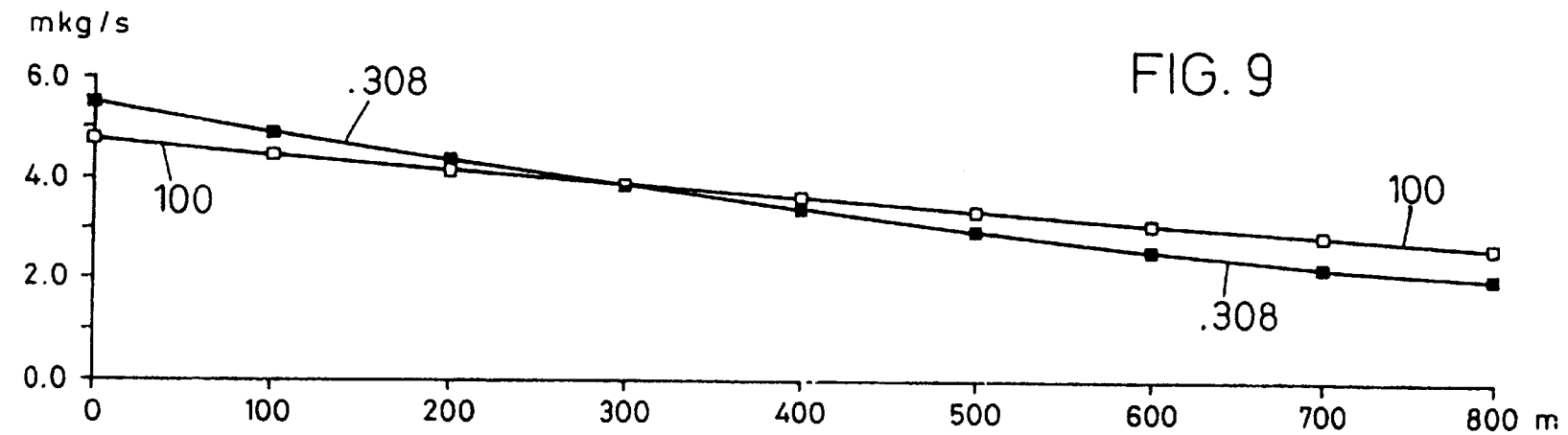
Figure 10:
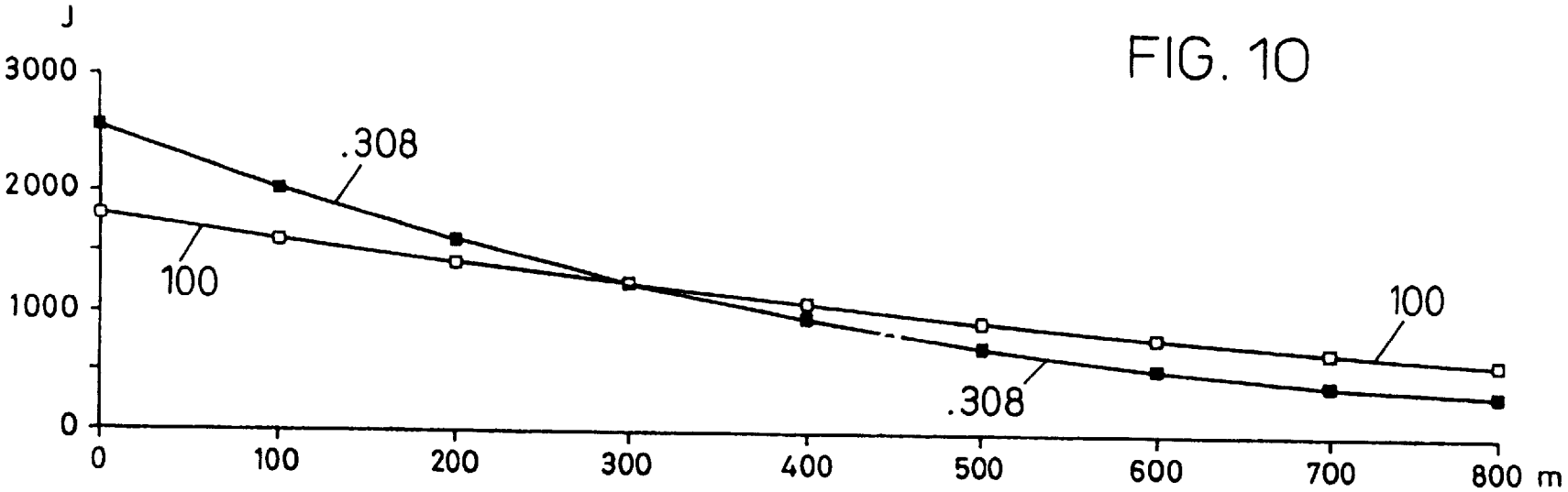
Figure 11:
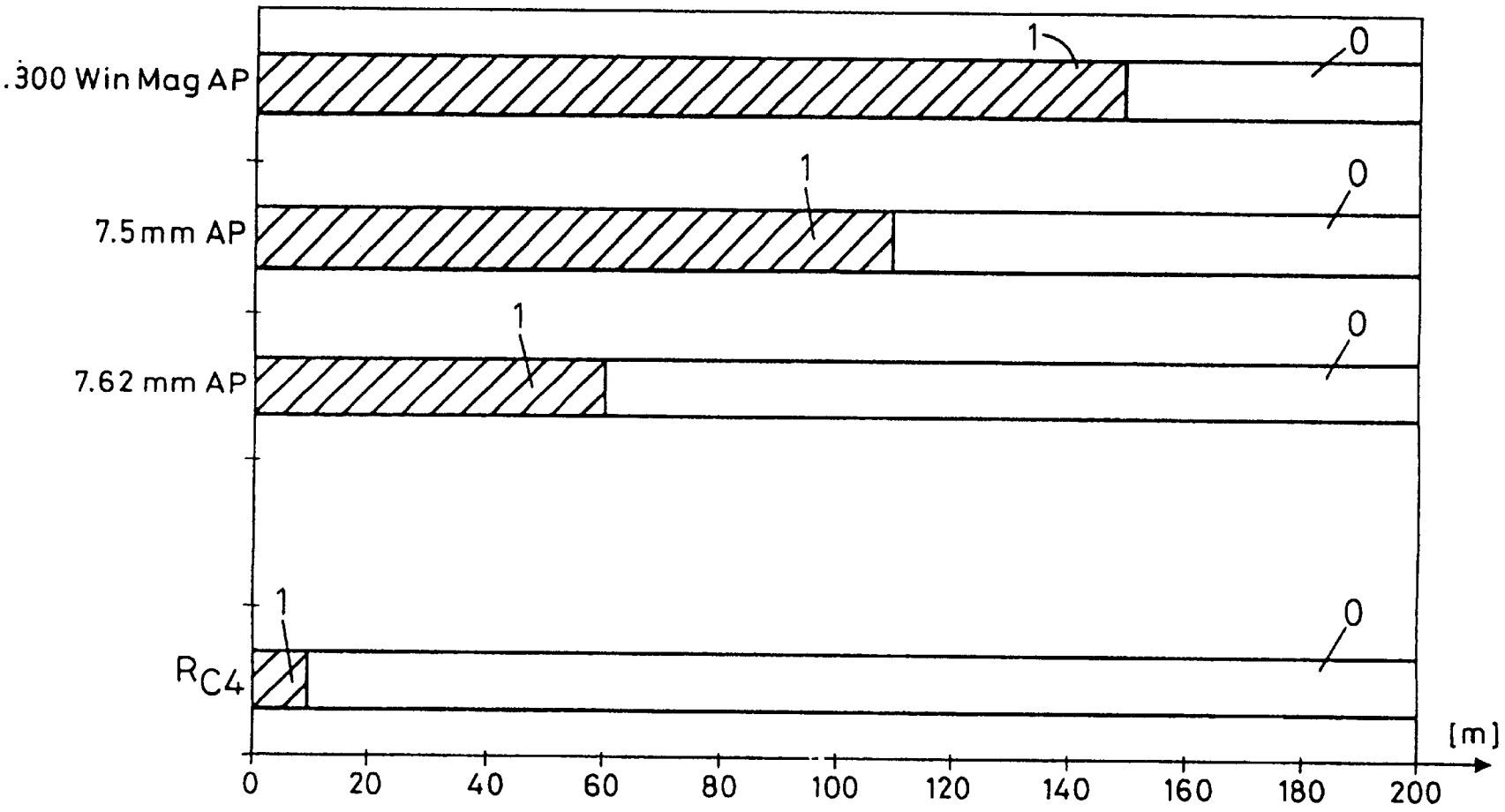
Figure 12:
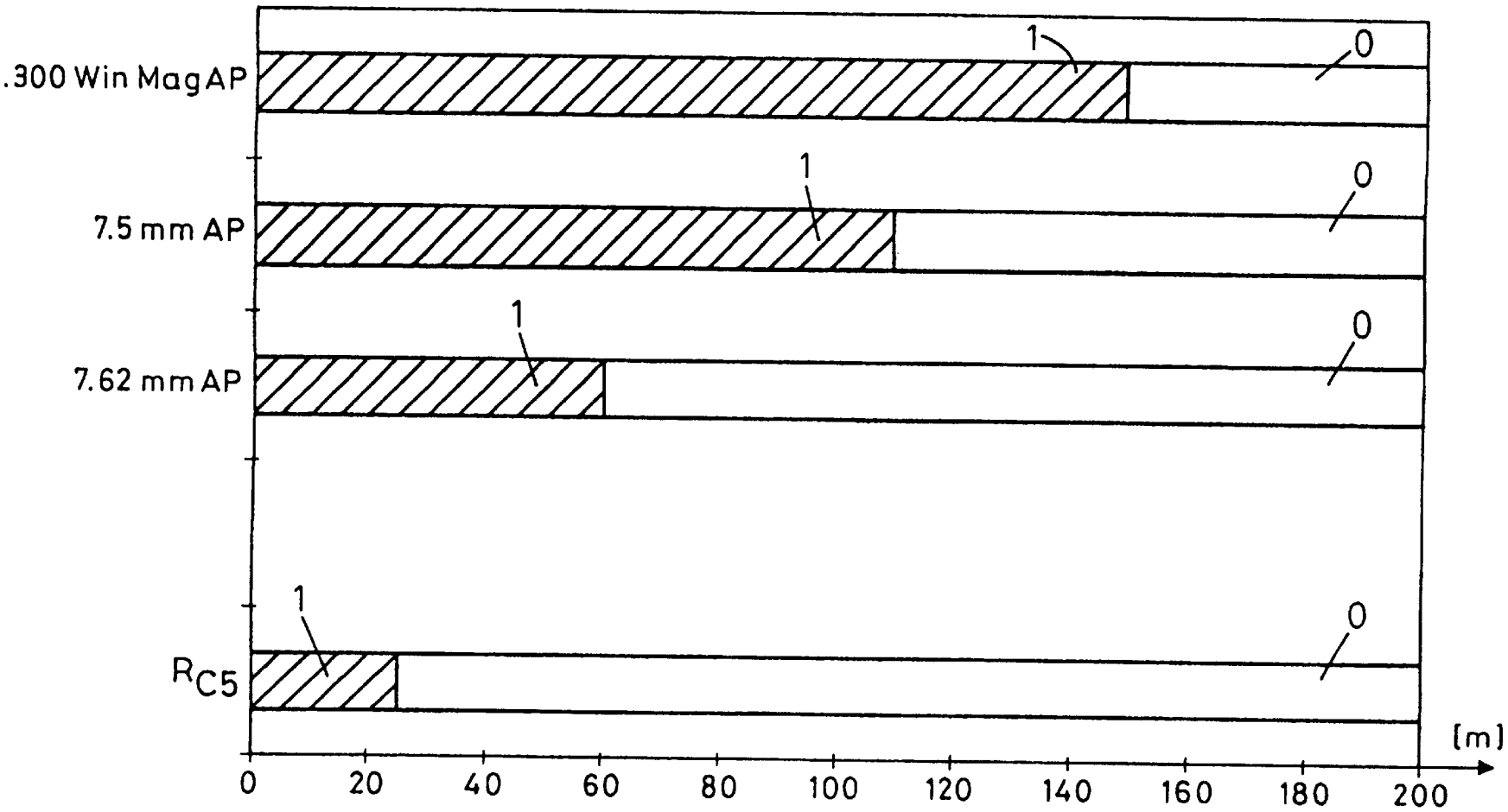

In these:

FIG. 1 shows a preferred projectile with rotationally symmetrical cores, inserted into a case containing propelling-charge powder, FIG. 1*a* shows an enlarged representation of the hard core of FIG. 1 in its characteristic size proportions, FIG. 2 shows a variant on the projectile in FIG. 1, with a convex hard-core head and modified tail region, FIG. 3*a–c* shows characteristic target diagrams of hard-core 7.5 mm calibre ammunition, shown at a firing distance of 200 m, FIG. 4 shows the projectile velocity of the ammunition according to FIG. 1 or 2, as a function of the distance, considered relative to the prior art, FIG. 5 shows the deceleration of the ammunition according to FIG. 1 or 2, at a firing distance of 100 to 800 m, relative to the prior art, FIG. 6 shows the crosswind sensitivity of the projectiles in relation to two projectiles according to the prior art, FIG. 7 shows the projectile momentum of the ammunition according to FIG. 1 or 2, shown over a flying distance of 800 m, relative to the prior art, FIG. 8 shows the projectile energy of the ammunition according to FIG. 1 or 2, shown over a flying distance of 800 m, relative to the prior art, FIG. 9 shows the hard-core momentum of the ammunition according to FIG. 1 or 2, shown over a flying distance of 800 m, relative to the prior art, FIG. 10 shows the hard-core energy of the ammunition according to FIG. 1 or 2, shown over a flying distance of 800 m, relative to the prior art, FIG. 11 shows the penetration capacity of three different calibres of hard-core ammunition as a function of the firing distance with a first class of armoured glasses, in relation to the standard requirement, and FIG. 12 shows the penetration capacity of the three different calibres as a function of the firing distance with a further class of armoured glasses, in relation to the standard requirement.

In FIG. 1, numeral 1 denotes a cartridge case, known per se, which contains a powder charge 2- a high-power propelling charge - likewise known. Into the cartridge 1 there is inserted a projectile 100, the head 4 of which is formed by a steel jacket 3. At the front the projectile has an ogive shape 7*a*, which merges into a cylindrical middle part 7*b*, having a twist groove 12 for fastening the case 1, and ends in a tail region 9. Let in the closed end 10 of the cartridge case 1 is, in a well-known manner, a detonating cap 11.

The hard core 5 has a truncated-cone-shaped tail region 5*b* which is covered by a precise-fitting internal shape of a soft core 8. A front region 5*a* is configured as a truncated cone with a vertex angle β; located between the latter and the concave internal shape of the projectile head 4 is an air space 6 which is essential to the functioning.

By means of flanging 13 at the tail, the steel jacket 3 encloses the three enclosed components: soft core 8, hard core 5 and air 6 with an interference fit.

In the following figures, like functional parts are given the same reference numerals.

The representation, enlarged as compared with FIG. 1, of the hard core 5 in FIG. 1*a* includes dimensions which apply to a preferred exemplary embodiment, a 7.5 calibre:

Overall length $L_1$ of the hard core 5=19 mm

Front length $L_2$=15 mm

Diameter D of the cylindrical middle part =6.64 mm

Ogive radius R =61.6 mm

Rounding r =0.2 −0.02 mm

Cone angle α=16.5°

Diameter d at the truncated-cone end =4.28 mm

Vertex angle α=80°

A second version of a steel-jacketed projectile 100' is depicted in FIG. 2, although in this case only the changes by comparison with FIG. 1 will be discussed:

The front region 5*a* is configured as a spherical cap and likewise serves - as in FIG. 1 - to compensate for manufacturing tolerances and, by means of the adjoining ogive-shaped part of the hard core 5' which is close-fitting in the jacket 3, likewise forms the gastight air space 6 in the projectile head 4.

The tail region 5*b* of the hard core 5' has an arbor-like part turned on on the lathe, which has only a small degree - not visible - of conicity and on which the soft core 8 is centred.

At the tail, a sealing disc 14 made of brass is inserted in the projectile 100' and, by means of the flanging 13, closes off the steel jacket 3 in a gastight manner, i.e. prevents the [sic] heavy metals and/or vapours escape upon firing. The soft core is shortened by the thickness of the sealing disc 14, with the projectile length being the same.

In both versions, the hard core consists of cobalt-alloyed tungsten carbide WC/Co 88/12 with a mass of 5.6 g and a Vickers hardness HV of 1300 kp/mm$^2$ and a flexural resistance of 3000 N/mm$^2$.

The soft core consists of an alloy of Pb/Sn 60/40 with a mess of 3.9 g. The steel jacket 3 weighs 3.11 g. The entire projectile mass in the first version, i.e. without sealing disc 14, is thus 12.61 g.

The subject matter of the invention was tested in numerous firing experiments, recorded over a distance of 800 m, and compared with the prior art.

FIGS. 3*a* to 3*c* show characteristic target diagrams at a firing distance of 200 m, a series of 20 shots at a time being fired at a target, with an inner circle of 5 cm and an outer circle of 10 cm in diameter. The hit rate in the innermost region of the target (so-called bull's-eye) was 95%. The ammunition used conforms to Swiss Ordinance calibre (7.5 ×55).

The same experiment with ammunition according to the prior art (.308 calibre) is not shown; the hit rate achieved in this case was less than 65%.

The velocity of the projectile 100 according to the invention is shown in FIG. 4 in relation to the prior art, denoted by 0.308.

From this, it can be seen that the velocity of the projectile 100 falls from 850 m/s initially (initial velocity $v_0$) almost linearly to only 580 m/s, at a distance of 800 m.

The representation, in FIG. 5, of the deceleration in m/s per m as a function of the firing distance in m underlines what is shown in FIG. 4.

Once again the high degree of linearity from a firing distance of 200 mm stands out.

FIG. 6 shows the lateral deviation of three projectiles in a wind with a velocity of 4.8 m/s occuring at right angles to the firing path.

The projectile 100 according to the invention has significantly better values by comparison with the prior art .308; for comparison, older Swiss Ordinance ammunition GP 11 was also tested and its relatively good values plotted in FIG. 6 as well.

In addition, the projectile momentum in mkg/s as a function as the firing distance was tested and recorded in FIG. 7.

Here, too, the projectile 100 shows significantly better values by comparison with the projectile .308.

As expected, the projectile energy in J, plotted in FIG. 8, is significantly higher for the projectile 100 by comparison with the projectile .308. This shows that even at a firing distance of 800 m the projectile 100 still has very considerable energy of about 1800 J and thus still possesses great penetration capability.

For the sake of completeness, in FIG. 9 and FIG. 10 the momentums of the hard core in the projectile 100 and the energy of the projectile 100 were measured and plotted in relation to the prior art.

The surprisingly good firing results of the subject matter of the invention are attributable not least to the favourable weight distribution within the projectile.

Penetration experiments using the armouring defined at the outset fully confirm the measurement results in practice.

It has been found that projectile jackets in brass alloys CuZn5 or CuZn10 show equivalent results, as FIGS. 11 and 12 prove on the basis of penetration experiments using armoured glass of class C4 and C5, respectively (penetration resistance according to DIN 52290/2);

In FIGS. 11 and 12, the distance to target, i.e. armoured glass, reliably penetrated in each case is indicated by hatching and denoted by "1", while the region situated thereabove is considered as not having been penetrated and is therefore denoted by 0.

According to FIG. 11, the standardized test arrangement for so-called insulating glasses of class C4 is plotted as reference R in the bottom bar, denoted by $R_{C4}$. According to DIN 52290/2, under test conditions, there must be no penetration up to a distance of 10 m in the case of three hits using 7.62×51 mm FMJ-type full-jacketed ammunition with a lead core. Consequently, the non-hatched region 0 in this case signifies: definitely not penetrated.

Ammunition designed in accordance with the invention, of calibre 7.62×51 mm (type AP), penetrates the same glass even with a single shot up to a distance of 60 m. The 7.5×55 calibre (type AP) penetrates this class of glass up to a distance of 110 m and the .300 WinMag calibre (type AP) even up to a distance of 150 m. The non-hatched region 0 in this case signifies: with a certain variation possibly in the border region likewise penetrated, which is proved by the considerable residual kinetic energy still present and detectable in all cases after the penetration of the glass.

FIG. 12 is analogously constructed; in this case, shots were fired at glass of class C5; The standardized test arrangement for glass of class C5 is denoted by the reference $R_{C5}$; again, for 7.62×51 mm FMJ/AP ammunition, i.e. in this case full jacket with a steel core.

The ammunition according to the invention is again several times more powerful in terms of penetration. The corresponding ammunition 7.62×51 AP results in penetration at a target distance of 60 m with this glass class as well; 7.5×55 AP at 110 m and 7.62×51 AP at 150 m. In all three cases, however, only a small amount of residual energy is still detectable after penetration through the glass.

In addition, no significant projectile deflection was found with any of the glasses which are conceivable in a police operation and are to be penetrated, provided that the point of entry was perpendicular to the glass.

When a projectile did not impact perpendicularly, at angles of incidence of 30° to the perpendicular, deflections of less than 5° where found.

The projectile design according to the invention is of course not limited to use with the above-mentioned calibres; with correspondingly larger propelling charges, likewise known per se, the projectiles may also be adapted to other small-calibre ammunition, in particular .300 Winchester Magnum.

Jacketed projectile (100) according to claim 1, characterized in that the jacket (3) is plated on the outside with a copper/zinc alloy.

Jacketed projectile (100) according to claim 1, characterized in that the hard core (5) is made of cobalt-alloyed tungsten carbide and has a density of more than 14.0 g/cm$^3$.

Jacketed projectile (100) according to claim 1, characterized in that the soft core (8) consists of lead and/or tin and has a density of at least 7.3 g/cm$^3$.

Jacketed projectile (100) according to claim 3 or claim 4, characterized in that the hard core (5) makes up between 42% and 50% and the soft core (8) between 28% and 34% of the entire projectile mass.

Jacketed projectile (100) according to claim 1, characterized in that the soft core (8) is closed off in a gastight manner at the tail by a brass disc (14) sealing with an interference fit against the jacket (3).

Jacketed projectile (100) according to claim 3 or claim 4, characterized in that the hard core (5) has at the tail a truncated cone with a cone angle ($\alpha$) between 14° to 18° and in that the soft core (8) is seated by its internal cone, with the same cone angle ($\alpha$), in a form-fitting manner on the truncated cone.

Jacketed projectile (100) according to claim 3 or claim 4, characterized in that the hard core (5) has at the tail a truncated cone with a cone angle ($\alpha$) between 0.5° to 14° and in that the soft core (8) is seated by its internal cone, with the same cone angle ($\alpha$), in a form-fitting manner on the truncated cone.

Process for manufacturing a jacketed projectile (100) according to claim 3, characterized in that the hard core (5), after compression moulding and sintering thereof, is tumbled in water until it is glossy.

Process for manufacturing a jacketed projectile (100) according to claim 1, characterized in that the tolerances of the individual components are chosen such that the hard core (5) can be manually pushed into the interior space of the jacket (100) and the soft core (8) can likewise be manually pushed onto the tail part of the hard core (5), before the flanging of the projectile tail is carried out.

What is claimed is:

1. Small-calibre projectile (100) with a jacket (3) made of steel, plated steel or brass, with at least in each case a hard core (5) arranged at the front, the hard core having a density of greater than 10 g/cm$^3$ and a truncated-cone-shaped soft core (8) arranged at the tail and having a density of less than 10 g/cm$^3$ the external shape of the jacket (3), considered from the projectile head (4), being configured in an ogive shape (7*a*), merging into a cylindrical middle part and ending in a conical tail region, a likewise ogive-shaped part of the hard core (5) lying in a form-fitting manner against a wide region of the ogive internal shape of the jacket (3) and forming a hollow space between the jacket (3) and the front region of the hard core (5), further characterized in that the hard core (5) merges, in its front region (5*a*), into a truncated-cone shape or spherical-cap shape and has a smoothened surface, in that a closed-off air space (6) exists between the inner surface of the jacket and the front region of the hard core (5), in that the tail region (5*b*) of the hard core is configured in a truncated-cone shape, in that the soft core (8) lies in a form-fitting centered manner against the truncated cone of the hard core (5) and the soft core filling the entire cylindrical middle part (7*b*) and the truncated-cone-shaped tail region (9) of the jacket.

2. Jacketed projectile (100) according to claim 1, characterized in that the jacket (3) is plated on the outside with a copper/zinc alloy.

3. Jacketed projectile (100) according to claim 1, characterized in that the hard core (5) is made of cobalt-alloyed tungsten carbide and has a density of more than 14.0 g/cm$^3$.

4. Jacketed projectile (100) according to claim 1, characterized in that the soft core (8) consists of lead and/or tin and has a density of at least 7.3 g/cm $^3$.

5. Jacketed projectile (100) according to claim 3 or claim 4, characterized in that the hard core (5) makes up between 42% and 50% and the soft core (8) between 20% and 34% of the entire projectile mass.

6. Jacketed projectile (100) according to claim 1, characterized in that the soft core (8) is closed off in a gastight manner at the tail by brass disc (14) sealing with an interference fit against the jacket (3).

7. Jacketed projectile (100) according to claim 3 or claim 4, characterized in that the hard core (5) has at the tail a truncated cone with a cone angle ($\alpha$) between 14° to 18° and in that the soft core (8) is seated by its eternal cone, with the same cone angle ($\alpha$), in a form-fitting manner on the truncated cone.

8. Jacketed projectile (100) according to claim 3 or claim 4, characterized in that the hard core (5) has at the tail a truncated cone with a cone angle ($\alpha$) between 0.5° to 14° and in that the soft core (8) is seated by its internal cone, with the same cone angle ($\alpha$), in a form-fitting manner on the truncated cone.

9. Process for manufacturing a jacketed projectile (100) according to claim 3, characterized in that the hard core (5), after compression moulding and sintering thereof, is tumbled in water until it is glossy.

10. Process for manufacturing a jacketed projectile (100) according to claim 1, characterized in that the tolerances of individual components are chosen such that the hard core (5) can be manually pushed into the interior space of the jacket (100) and the soft core (8) can be likewise be manually pushed onto the tail part of the hard core (5), before the flanging of the projectile tail is carried out.

* * * * *